US006384708B1

(12) United States Patent
Jöllenbeck et al.

(10) Patent No.: US 6,384,708 B1
(45) Date of Patent: May 7, 2002

(54) ELECTRICAL FUSE ELEMENT

(75) Inventors: André Jöllenbeck, Bochum; Manfred Rupalla, Witten; Andreas Baus, Dortmund, all of (DE)

(73) Assignee: Wickmann-Werke GmbH (DE)

( * ) Notice: Subject to any disclaimer, the term of this patent is extended or adjusted under 35 U.S.C. 154(b) by 0 days.

(21) Appl. No.: 09/508,047

(22) PCT Filed: Aug. 29, 1998

(86) PCT No.: PCT/EP98/05514

§ 371 Date: Mar. 3, 2000

§ 102(e) Date: Mar. 3, 2000

(87) PCT Pub. No.: WO99/12178

PCT Pub. Date: Mar. 11, 1999

(30) Foreign Application Priority Data

Sep. 4, 1997 (DE) ..... 197 38 575

(51) Int. Cl.[7] ..... H01H 85/046; H01H 85/044; H01H 85/143

(52) U.S. Cl. ..... 337/297; 337/290; 337/295; 439/890

(58) Field of Search ..... 337/152, 160, 337/227, 297, 296, 231, 159, 404, 228, 290, 295, 405, 417; 29/623; 439/366, 622, 890, 893; 257/665; 327/525; 438/601

(56) References Cited

U.S. PATENT DOCUMENTS

| | | | | | |
|---|---|---|---|---|---|
| 1,927,905 | A | * | 9/1933 | Slepian et al. | 200/131 |
| 4,001,863 | A | * | 1/1977 | Kobayashi et al. | 357/30 |
| 4,394,639 | A | | 7/1983 | McGalliard | |
| 4,862,134 | A | * | 8/1989 | Poerschke et al. | 337/231 |
| 5,097,246 | A | * | 3/1992 | Cook et al. | 337/297 |
| 5,389,814 | A | * | 2/1995 | Srikrishnan et al. | 257/529 |
| 5,469,981 | A | * | 11/1995 | Srikrishnan et al. | 216/13 |
| 5,585,662 | A | * | 12/1996 | Ogawa | 257/529 |
| 5,914,649 | A | * | 6/1999 | Isono et al. | 337/290 |
| 5,929,741 | A | * | 7/1999 | Nishimura et al. | 337/290 |
| 5,982,268 | A | * | 11/1999 | Kawanishi | 337/297 |
| 6,040,754 | A | * | 3/2000 | Kawanishi | 337/297 |

FOREIGN PATENT DOCUMENTS

| | | | | |
|---|---|---|---|---|
| AU | 526077 B | | 12/1982 | |
| DE | 86 26 664 | | 12/1987 | |
| DE | 296 16 063 U1 | | 12/1996 | |
| JP | 6176680 A | * | 6/1994 | 337/290 |
| JP | 10-106425 A | * | 4/1998 | H01H/85/00 |
| WO | 96/08832 | | 3/1996 | |
| WO | 9608832 | | 3/1996 | |

OTHER PUBLICATIONS

Patent Abstracts of Japan: vol. 097, No. 009 Sep. 30, 1997; JP 09 115418A (Matsuo Denki KK) May 2, 1997.

Patent Abstracts of Japan: vol. 097, No. 001, Jan. 31, 1997 & JP 08 236003 A (Hitachi Chem Co Ltd), Sep. 13, 1996.

Neuhalfen A.J.: "Miniaturization of Circuit Protection Devices to Meet Surface Mount Applications" ISBN# 0–7803–2636–9, Nov. 7, 1995, pp. 172–177, XP00586566.

* cited by examiner

*Primary Examiner*—Leo P. Picard
*Assistant Examiner*—Anatoly Vortman
(74) *Attorney, Agent, or Firm*—Banner & Witcoff, Ltd.

(57) ABSTRACT

An electrical fuse element (1), which comprises a substrate (4) with two contacts (2) arranged on opposite end sides (3), terminal areas (7) connected to the contacts and a fusible conductor (10) electrically connected in a conducting manner to the contacts via the terminal areas, is developed for use in higher voltage ranges, with improved breaking capacity and with low production costs, by the terminal areas (7) and the fusible conductor (10) being arranged separated from one another by an insulator (4) and electrically connected to one another via lead-throughs.

18 Claims, 3 Drawing Sheets

ELECTRICAL FUSE ELEMENT

FIELD OF THE INVENTION

The present invention relates to an electrical fuse element which comprises a substrate with two contacts arranged on opposite end sides, terminal areas connected to the contacts which run in the same plane and a fusible conductor electrically connected in a conducting manner to the contacts via the terminal areas.

BACKGROUND OF THE INVENTION

Fuse elements of the above-mentioned type are today preferably produced as surface-mounted devices (SKD) using fusible conductors in the form of conducting layers or pieces of wire. Owing to the small dimensions, it is attempted by the use of special materials and/or by a complex inner structure to extend the fullest voltage range in which such components can be used.

An example for a SMD-type fuse of the above mentioned type is disclosed in WO-A-96/08832. This suminiature circuit protector consists of several layers of ceramic material, where on each layer terminal areas connected to a fuse element are arranged. Terminal areas of different layers are interconnected in parallel or in series by lead-throughs extending from one layer to another through the ceramic material.

It is the object of the present invention to develop fuse elements of the aforementioned type at low production costs for use in higher voltage ranges with an improved breaking capacity.

The object is achieved according to the invention by the terminal areas and the fusible conductor being arranged separated from one another by an insulator and electrically connected to one another via leadthroughs, where the terminal areas and the fusible conductor run in different planes In known SMD fuse elements, the fusible conductor, as the actual functional element of a fuse, goes over directly into the other electrically conducting components of the fuse, in particular into the terminal areas. For this purpose, usually all the components are arranged on the surface of a substrate. At the moment of breaking the current, the fusible conductor melts through in the region of the hottest area, the "hot spot". The current flow is not instantaneously interrupted, however, but is maintained by an arc. According to the prior art, it is attempted by particular material selection and/or design measures to quench this breaking arc as quickly as possible and to suppress the subsequent striking of a secondary arc. While the breaking arc or primary arc is produced whenever breaking occurs and is fed by the melting material of the fusible conductor itself, in the case of arcing back, that is when a secondary arc is produced, the metal adjoining the fusible conductor—usually in the form of conducting tracks—is also involved in the arcing process. Consequently, the secondary arc spreads beyond the region of the actual fusible conductor and may even reach the external terminals of the SMD fuse element. In this case, the fuse can no longer perform a protective function and even additionally damages surrounding components by the arc.

SUMMARY OF THE INVENTION

A different geometry is described in AU-B-40791/78. Here, a houshold type fuse is disclosed where on opposite sides of an insalator terminal areas are arranged. Two fusible links are also arranged on opposite sides of the insalator, electrically connected to the terminal areas and to each other by leadthroughs. In this arrangement, a distance is kept between the terminal areas and the fusible links. However, arc flashover is not effectively prevented by this arrangement.

With otherwise the same switching geometry, by contrast with such fuses according to the prior art, a fuse element according to the invention suppresses the effect described by the fusible conductor being arranged separated from all the other parts of the fuse by an insulator. Lead-throughs provide the electrically conducting connection of the fusible conductor through the insulator to the external contacts. When breaking the current, after consuming or vaporizing the conductive material of the fusible conductor, the arc burns up to the lead-throughs in the insulator. From this moment on, there is no more material to he vaporized available, since the material of the lead-throughs lying in the insulator cannot be melted and vaporized by the arc. Even a possibly struck secondary arc must consequently extinguish quickly, since it can no longer be maintained. The fuse element consequently breaks the current reliably and, on account of the minimizing of conductive material available for the arc, quickly after it blows. Accordingly, with the same dimensioning and overall size, a fuse according to the invention has a considerably greater breaking capacity than known fuses, since it always keeps the arc confined to the region of the fusible conductor, with the result that, after consuming or vaporizing the small amount of conductive material of the fusible conductor between the lead-throughs on the insulator, the arc can no longer find any further "food".

According to the invention, the terminal areas and the fusible conductor are arranged separated from one another by the insulator in such a way that they run in different planes. An arc flashover is consequently prevented particularly effectively.

The insulator is advantageously made up by one or more layers of dielectric pastes. The insulator may thus be arranged as an insulating layer on the substrate, preferably by screen printing. Many inexpensive processes of adequate accuracy, in particular using pastes capable of cofiring, are known from the field of thick-film and thin-film circuitry. In very cost-effective processes, insulators can consequently be produced in multiple repeats as dielectric layers which also have a surface quality which allows the use of known processes for applying or attaching and contacting a fusible conductor on the respective insulator with great reliability.

In a preferred embodiment, the insulator is formed by the substrate itself, with the result that no additional material has to be used for the separation of terminal areas and fusible conductor. This feature also allows at least one process step to be saved in comparison with customary production processes. In a preferred embodiment of the invention, the two planes on which the fusible conductor on the one hand and the terminal areas on the other hand are arranged spatially separated from one another and connected via lead-throughs represent the upper side and the underside of the substrate.

The short burning duration and the strict spatial confinement of the arc described above also make it possible to use customary fusible conductor coverings in the "hot spot" towards the outside, preferably a glass covering. In mass production, this additionally has the effect of lowering the unit price of fuse elements according to the invention.

A fuse element according to the invention is advantageously not restricted to the use of a particular substrate material. For example, a composite plastic, such as for example FR4, or other customary circuit board materials may be used as the substrate material. Preferably, however, a ceramic material and, in particular, a glass ceramic is used as the substrate in a fuse according to the invention.

In a particularly advantageous development, the leadthroughs are designed as plated-through holes and, according to Claim 11, consist of a conductive sintered material, which is preferably filled into holes of a refractory substrate, such as for example a ceramic, and subsequently solidified in a thermal process. With these comparatively narrow lead-throughs, when an arc occurs there may also be a phenomenon referred to as the channelling effect with a positive influence on the extinction of the arc, by which effect an arc passing through a narrow channel "blows itself out".

However, ceramic manufacturers also offer ready-made and ready-sintered substrate materials, which can be provided with plated-through holes by drilling and heating once the drilled holes have been filled with sinterable material. Applying the terminal areas and any leads to the plated-through holes on the one hand and a fusible conductor on the other hand, for example in a thick-film process, may be followed by individual separation by sawing. Preferred, however, is a breaking of the ceramic into individual elements, which is preferably assisted by defined weakening of the material by scoring or lasering.

In a preferred apparatus, the holes are made by punching a green ceramic layer, it being possible after filling with the sinterable mass for the materials also to be cured together in a single thermal step or sintering process.

According to a particularly advantageous embodiment of the invention, a planar green glass ceramic is provided with holes in multiple repeats and filled with a sinterable mass. Depending on the material selection, before the sintering step, terminal areas can be applied to the one surface and fusible conductors between the later plated-through holes can be applied to the other surface, for example in a thick-film process. Subsequently, likewise before the sintering step, the fuse elements can be individually separated by cutting the green glass ceramic layer.

In a further embodiment of the invention, the two planes on which the fusible conductors or terminal areas and leads are arranged represent upper sides and/or undersides of two insulator layers or substrate layers. After bonding together of the two layers, the terminal areas and leads then lie, for example, between the two substrate layers and are thus closed off from the surroundings and electrically accessible only via the external contacts.

In the case of the production of a fuse according to the invention from unfired glass ceramic, there is consequently advantageously the possibility of bonding together the two layers in the green state by pressing them together and in that case by adhesive bonding. As a result, after the firing operation, preferably using printing pastes capable of cofiring, a compact and stable unit can be formed. The individual elements can easily be separated from one another by cutting just after lamination, in the still unfired state. Here there is then a conducting layer of each fuse already insulated with respect to the surroundings, with the result that, for example, it is possible to dispense with a possibly necessary covering for the fusible conductor or else the terminal areas and leads. Further layers may additionally be used as the covering.

The structure of a fuse element described above may also be advantageously inverted, with the result that the fusible conductor is arranged between the substrate and insulator or covering, and the terminals and leads run freely over the surface, partially covering over the lead-throughs for reliable contacting. By this structure, the fusible conductor is enclosed in a fuse housing which has comparatively good heat conduction. This property may be used advantageously for usefully increasing the breaking capacity of the fuse.

The principle according to the invention of a spatial separation of the fusible conductor and the broad terminal contacts and of any leads by an insulating layer, for example accomplished using plated-through holes, is advantageously not restricted to the field of miniature fuses or SMD fuse elements. It may also be applied with the same effect in greater voltage ranges both using layer-type fusible conductors and wire-type fusible conductors of all other types of fuse.

While using simple techniques, a fuse element according to the invention has the effect of achieving what is overall a surprisingly high increase in breaking capacity. At the same time, the operational reliability is increased also when breaking a current below the maximum for which the fuse is designed, since a structure according to the invention greatly reduces the time for which an arc occurs and consequently reduces the thermal loading on the fuse as a whole.

Exemplary embodiments of the invention are described in more detail below with reference to the drawing. In the illustrations:

DETAILED DESCRIPTION OF THE INVENTION

Figure 1:
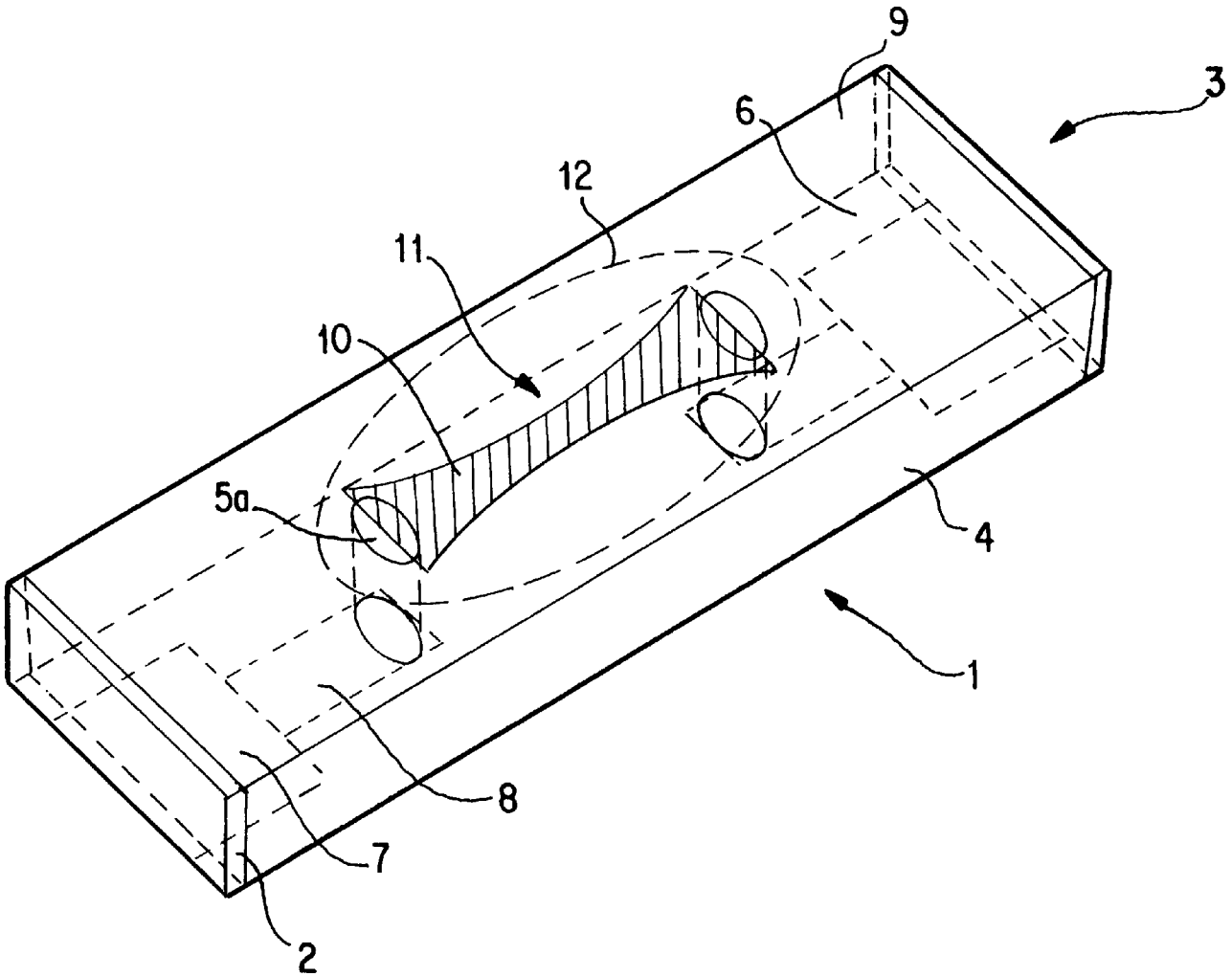
FIG. 1 shows a perspective representation of an SMD-mountable fuse element and FIG. 2 shows a sectional representation of an alternative embodiment.

The representation of FIG. 1 shows an SMD-mountable fuse element 1 with external contacts 2, which are applied by a "dip and blot" process to end faces 3 of a substrate 4. The substrate 4 consists of a single-layer glass ceramic, which in the unfired state is provided with-holes for producing plated-through holes 5*a* and is filled with a sinterable mass which is electrically conductive after sintering.

Arranged on an underside 6 of the substrate 4 are terminal areas 7, which are connected to leads 8. The terminal areas 7 and leads 8 have been printed onto the ready-fired substrate 4 in a thick-film process. A fusible conductor 10 has been applied to an upper side 9, in the present case likewise in a thick-film process, very thin layer thicknesses being accomplished for the fusible conductor 10, of about 300 $\mu$m, by using a resinate paste. For other nominal current ranges, the fusible conductor 10 may be designed as a thick-film fusible conductor or else, for example, as a wire-type fusible conductor. In all cases, the fusible conductor 10 extends from one plated-through hole 5*a* to the other, the layer-type fusible conductor chosen in this embodiment being greatly tapered at one location, the hot spot 11. To bring about defined current breaking at this location, all the other regions of the conductive pathway are designed to be much broader and consequently to have less electrical resistance.

The hot spot 11 is coated in a known way with a covering 12 of a silicone paste in order to take up vaporized metal particles during the current breaking of the fuse 1 and in order to protect the fusible conductor from environmental influences.

In this exemplary embodiment there is obtained a conducting path from one contact 2 to the other, which path runs over two planes, namely the upper side 9 and the underside 6 of the substrate 4, through the substrate 4 as the insulator. In this case, the fusible conductor 10 and the leads 8 with the terminal areas 7 are arranged separated from one another, with the result that, during current breaking, an arc can form only in the region of the fusible conductor 10 and, moreover, remains confined to this region. The plated-through holes 5*a* consist of burning-off-resistant sintered material and consequently withstand the arc. After complete vaporization of the very small amount of material of the fusible conductor 10, an arc must extinguish, since there is consequently no more material available.

On account of the short breaking times thus accomplished, which only by utilizing the increased breaking capacity of the fuse 1 described allow a certain time beyond the occurrence of an arc at all, it is also possible to use apart from ceramics, or preferably glass ceramics as substrate materials also simple circuit board materials, such as for example FR4, depending on the requirement for accuracy of the fuse characteristics and the intensity of the breaking current aimed for.

Very efficient and technically perfected standard processes for the production of such simple fuses, for example on the basis of FR4, are known from circuit board production. However, efficient multiple-repeat production processes are also possible using a glass ceramic. In this case, the fact that ceramics, and glass ceramics specifically, can be easily worked in the unfired state is utilized as an advantage. Thus, the fuse element described on the basis of the illustration is produced as a multiple repeat from a sheet-like green, that is unfired, glass ceramic. In this case, the green ceramic is provided with holes in a first step. Impressions may also be made here in order to prepare for the later individual separation of the fuses by breaking.

In a further step, the holes are filled with a sinterable mass, which can be cured together with the large substrate plate in a single sintering step. Thereafter, the sinterable mass is electrically conducting. As already described above, terminal areas and leads are then applied to the one surface, for example in a screen-printing process, and fusible conductors are applied to the other surface, possibly in a different process, they are solidified and covered in the hot spot area. This is followed by the individual separating step. Thereafter, the contacts are applied to the end faces, that is the end edges 3, in a dip and blot process or in a galvanic process.

Figure 2:
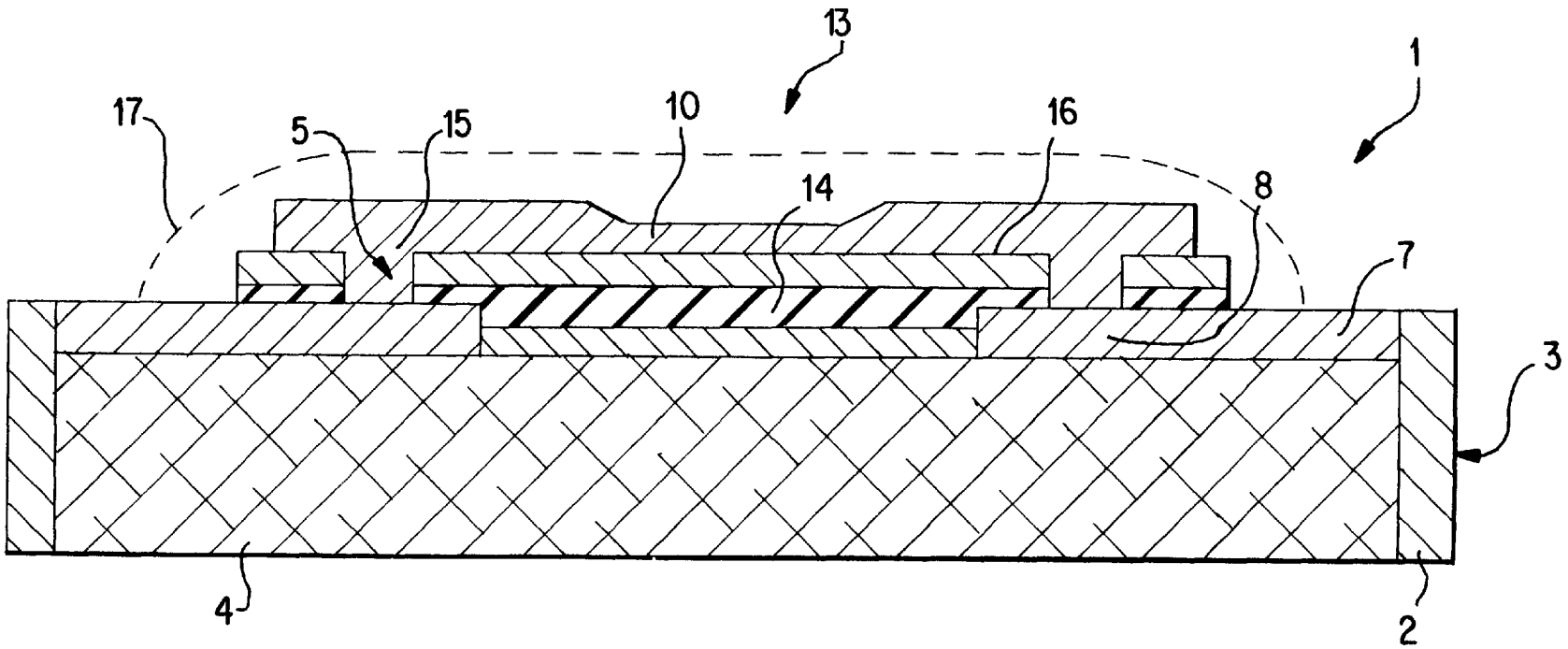
Figure 3:
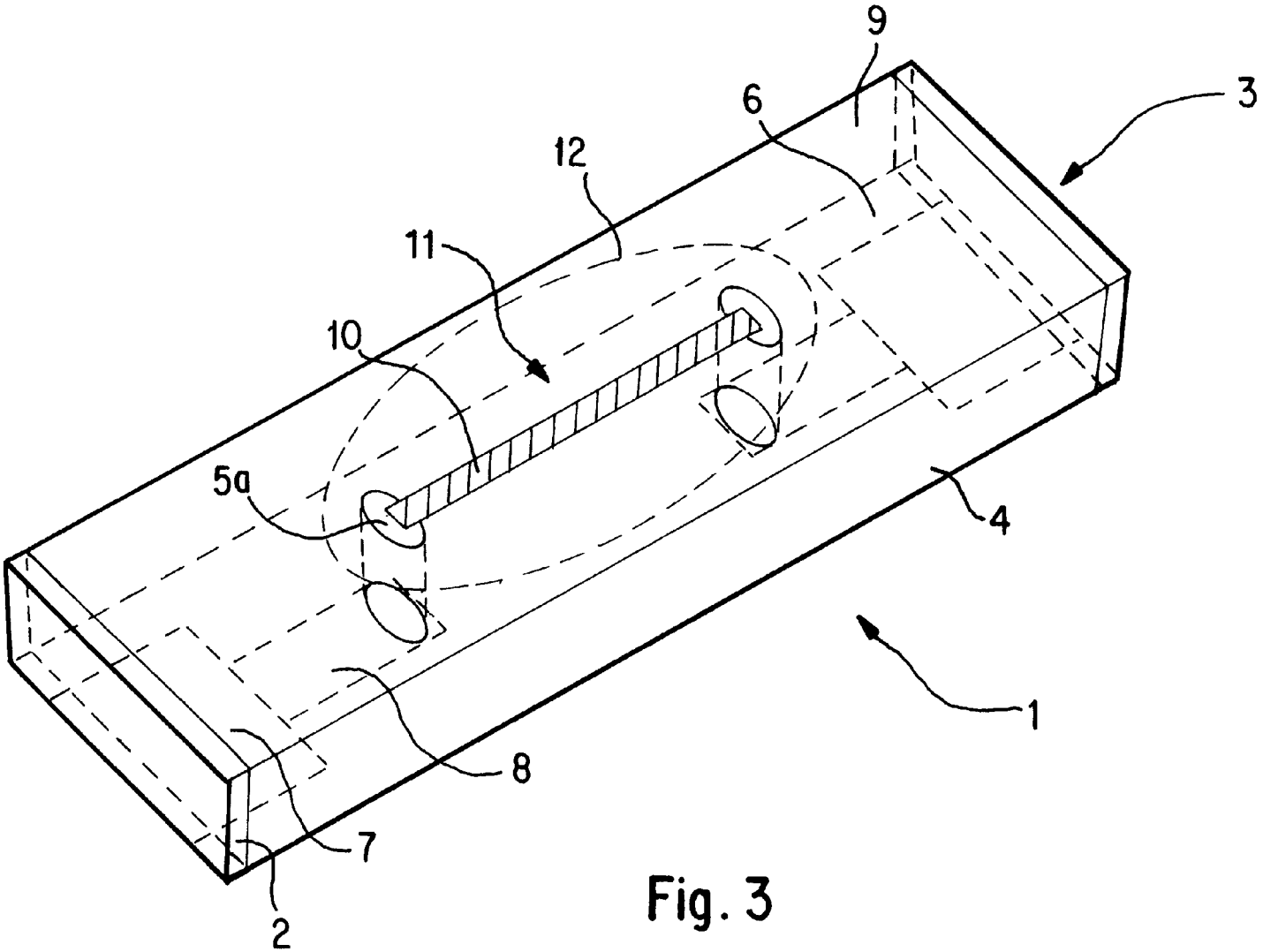

Sketched in FIG. 2 is a sectional representation of an alternative embodiment of an electrical fuse element 1. Here, by analogy with the embodiment from FIG. 1, the substrate 4 has been provided on the end faces 3 with external contacts 2, which are connected in an electrically conducting manner on the upper side 9 of the substrate 4 to terminal areas 7 and/or leads 8. However, as a difference with respect to the embodiment from FIG. 1, in a central region 13 there is now applied to the upper side 9, in a screen-printing process, an insulating layer 14, which also partially covers the terminal areas 7 and leads 8. Over the leads 8, the insulating layer 14 has holes 15, which are subsequently filled with a silver paste. Thus, relatively inexpensive lead-throughs 5, which nevertheless can meet the most important requirements of a fuse according to the invention, are produced in simple screen-printing process steps.

Thereafter, the actual fusible conductor 10 with a taper is applied to the surface 16 of the insulating layer 14, likewise in a screen-printing process, here also in the form of a silver paste. The pastes used are all capable of cofiring, with the result that only short drying intervals should be interposed between the individual production steps or printing steps. The arrangement is solidified in a common sintering step, resulting in electrically reliable connections from the external contacts 5 via the contact areas 7, leads 8, lead-throughs 5 in the holes 15 of the insulating layer 14 to the fusible conductor 10.

An outer covering 17 is printed over the entire central region as a paste after the sintering step and, after setting of the paste, forms a reliable protection for the arrangement against environmental influences and damage by external mechanical effects.

What is claimed is:

1. Electrical surface mountable fuse element for protecting against current surges comprising:

an insulator comprising first and second surfaces and a plurality of holes extending through said insulator between said first and second surfaces;

a plurality of lead-throughs each positioned in a respective one of said holes in said insulator, said lead-throughs extending between said first and second surfaces of said insulator;

a fusible conductor extending along said first surface of said insulator, said conductor having first and second terminal ends in electrical communication with said first and second lead-throughs, wherein at least a portion of each said lead-through is positioned between said terminal ends of said fusible conductor;

first and second electrically conductive contacts; and first and second terminal areas each connected to a respective one of said contacts and a respective one of said lead-throughs, said terminal areas being spaced from said fusible conductor by said insulating material and extending along said second surface of said insulator.

2. Electrical fuse element according to claim 1, wherein the insulator comprises a plurality of layers arranged on a substrate.

3. Electrical fuse element according to claim 2, wherein the insulator forms a substrate.

4. Electrical fuse element according to claim 1, wherein a covering formed from a silicone mass covers at least a hot spot of the fusible conductor.

5. Electrical fuse element according to claim 1, wherein the fusible conductor is a layer-type fusible conductor.

6. Electrical fuse element according to claim 1, wherein the fusible conductor is a wire-type fusible conductor.

7. Electrical fuse element according to claim 2, wherein the substrate consists of a plastic or composite plastic.

8. Electrical fuse element according to claim 2, wherein the substrate consists of a ceramic.

9. Electrical fuse element according to claim 1, wherein the lead-throughs are plated-through holes.

10. Electrical fuse element according to claim 9, wherein the plated-through holes consist of a conductive sintered material.

11. Electrical fuse element according to claim 9, wherein the plated-through holes are connected to the terminal areas via leads.

12. Electrical fuse element according to claim 11, wherein at least one of the components of the fuse, the terminal area, lead, fusible conductor, comprises a thick film or a thin film.

13. Electrical fuse element according to claim 2, wherein a covering formed from a silicone mass covers at least a hot spot of the fusible conductor.

14. Electrical fuse element according to claim 2, wherein the fusible conductor is a layer-type fusible conductor.

15. Electrical fuse element according to claim 2, wherein the fusible conductor is a wire-type fusible conductor.

16. Electrical fuse element according to claim 7, wherein the plastic or composite plastic includes FR4.

17. Electrical fuse element according to claim 2, wherein the substrate consists of a glass ceramic.

18. Electrical fuse element according to claim 10, wherein the plated-through holes are connected to the terminal areas via leads.

* * * * *